US009966022B2

(12) United States Patent
Cao et al.

(10) Patent No.: US 9,966,022 B2
(45) Date of Patent: *May 8, 2018

(54) DISPLAY METHOD AND DISPLAY DEVICE APPLIED TO MVA WIDE VIEWING ANGLE LIQUID CRYSTAL SCREEN

(71) Applicants: HISENSE ELECTRIC CO., LTD., Shandong (CN); HISENSE USA CORPORATION, Suwanee, GA (US); HISENSE INTERNATIONAL CO., LTD., Shandong (CN)

(72) Inventors: Jianwei Cao, Shandong (CN); Shunming Huang, Shandong (CN); Weidong Liu, Shandong (CN)

(73) Assignees: Hisense Electric Co., Ltd., Shandong (CN); Hisense USA Corporation, Suwanee, GA (US); Hisense International Co., Ltd., Shandong (CN)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/442,154

(22) Filed: Feb. 24, 2017

(65) Prior Publication Data

US 2017/0169773 A1 Jun. 15, 2017

Related U.S. Application Data

(63) Continuation of application No. 14/789,268, filed on Jul. 1, 2015, now Pat. No. 9,626,919.

(30) Foreign Application Priority Data

Jan. 27, 2015 (CN) ..... 2015 1 0045007

(51) Int. Cl.
*G09G 3/20* (2006.01)
*G09G 3/36* (2006.01)

(52) U.S. Cl.
CPC ..... *G09G 3/3607* (2013.01); *G09G 3/2007* (2013.01); *G09G 2300/0447* (2013.01); (Continued)

(58) Field of Classification Search
CPC ..... G09G 3/3607; G09G 2300/0447; G09G 2300/0452; G09G 2300/0465; (Continued)

(56) References Cited

U.S. PATENT DOCUMENTS

2008/0246780 A1 10/2008 Cho
2009/0262106 A1 10/2009 Lu et al.
(Continued)

*Primary Examiner* — Larry Lee
(74) *Attorney, Agent, or Firm* — Hoffmann & Baron, LLP

(57) ABSTRACT

According to the method provided by some embodiments of the present disclosure, under different gray-scale voltages, the liquid crystal deflection directions of liquid crystal molecules are different, such that when a first frame is displayed, the deflection difference between the deflection direction of the liquid crystal molecules in the pixel structure in the liquid crystal display screen and the deflection direction when a second frame is displayed is increased, after human eyes view the displayed first frame and second frame, an image obtained after the first frame and the second frame are displayed may be observed at different viewing angles, and at this time, the viewing angle of the liquid crystal display screen is increased on the premise of not increasing the number of sub-domains in the pixel structure of the liquid crystal display screen.

8 Claims, 11 Drawing Sheets

(52) U.S. Cl.
CPC ..... *G09G 2300/0465* (2013.01); *G09G 2320/0276* (2013.01); *G09G 2320/0673* (2013.01); *G09G 2340/16* (2013.01)

(58) Field of Classification Search
CPC ... G09G 2320/0233; G09G 2320/0276; G09G 2320/028; G09G 2320/068
See application file for complete search history.

(56) References Cited

U.S. PATENT DOCUMENTS

2013/0094754 A1 4/2013 Lee et al.
2013/0321483 A1 12/2013 You et al.

DISPLAY METHOD AND DISPLAY DEVICE APPLIED TO MVA WIDE VIEWING ANGLE LIQUID CRYSTAL SCREEN

CROSS-REFERENCE TO RELATED APPLICATIONS

This application is a continuation of U.S. application Ser. No. 14/789,268, filed Jul. 1, 2015, now U.S. Pat. No. 9,626,919, which claims the benefit of and priority to Chinese Patent Application No. 201510045007.X, filed on Jan. 27, 2015. The entire disclosures of the above applications are incorporated herein by reference.

FIELD

The present disclosure relates to the field of image display technology, and particularly relates to a display method and display device applied to an MVA wide viewing angle liquid crystal screen.

BACKGROUND

In the field of liquid crystal display screens, the display resolution of the liquid crystal display screens is improved continuously, and the requirements of consumers on the liquid crystal display screens change from higher display resolution into wider display angles. The current mainstream high-resolution liquid crystal display screens mainly adopt MVA (Multi-domain Vertical Alignment) technology to expand the viewing angles of the liquid crystal display screens.

SUMMARY

In one aspect, some embodiments of the present disclosure provide a display device applied to an MVA (Multi-domain Vertical Alignment) wide viewing angle liquid crystal screen. The display device includes a memory and one or more processors. The memory is configured to store one or more computer readable program codes. The one or more processors are configured to execute the one or more computer readable program codes to:

obtain a first frame and a second frame to be displayed, wherein the first frame and the second frame are two frames which are adjacent in a display order;

set pixels having same coordinates in the first frame and the second frame as respective groups of pixels, wherein each group of pixels comprises a first pixel in the first frame and a second pixel in the second frame;

adjust each group of pixels according to a following manner to obtain an adjusted first frame and an adjusted second frame: determine an average gray-scale value of the first pixel and the second pixel; and modify a first gray-scale value corresponding to the first pixel into a third gray-scale value, and modify a second gray-scale value corresponding to the second pixel into a fourth gray-scale value, wherein when the third gray-scale value is larger than the average gray-scale value, the fourth gray-scale value is smaller than the average gray-scale value, and when the third gray-scale value is smaller than the average gray-scale value, the fourth gray-scale value is larger than the average gray-scale value; and control the MVA wide viewing angle liquid crystal screen to display the adjusted first frame and the adjusted second frame according to the display order.

In another aspect, some embodiments of the present disclosure provide a display device applied to an MVA (Multi-domain Vertical Alignment) wide viewing angle liquid crystal screen. The display device includes a memory and one or more processors. The memory is configured to store one or more computer readable program codes. The one or more processors are configured to execute the one or more computer readable program codes to:

obtain a first frame and a second frame to be displayed, wherein the first frame and the second frame are two frames which are adjacent in the display order;

determine gray-scale voltage of each pixel in the first frame according to a preset first gamma value, and determine gray-scale voltage of each pixel in the second frame according to a second gamma value, wherein the preset gamma value is adopted by the first frame, the second gamma value is determined via the preset first gamma value and adopted by the second frame, and the first gamma value is different from the second gamma value; and control the MVA wide viewing angle liquid crystal screen to display the first frame according to the gray-scale voltage of each pixel in the first frame and then display the second frame according to the gray-scale voltage of each pixel in the second frame.

In still another aspect, some embodiments of the present disclosure provide a display device applied to an MVA (Multi-domain Vertical Alignment) wide viewing angle liquid crystal screen. The display device includes a memory and one or more processors. The memory is configured to store one or more computer readable program codes. The one or more processors are configured to execute the one or more computer readable program codes to:

obtain a first frame and a second frame to be displayed, wherein the first frame and the second frame are two frames which are adjacent in the display order;

divide the first frame into a plurality of first pixel groups, and divide the second frame into a plurality of second pixel groups, wherein each first pixel group comprises at least two adjacent pixels, the pixels contained in each first pixel group are different, and coordinates of pixels in the second pixel groups correspond to coordinates of the pixels in the first pixel groups in a one-to-one correspondence;

adjust gray-scale values of the pixels in the first pixel groups and corresponding second pixel groups according to a following manner to obtain an adjusted first frame and an adjusted second frame: determine a first gray-scale value corresponding to the first pixel in a first pixel group and a second gray-scale value corresponding to the second pixel in the first pixel group, and determine a first average gray-scale value according to the first gray-scale value and the second gray-scale value; modify the first gray-scale value corresponding to the first pixel in the first pixel group into a third gray-scale value, and modify the second gray-scale value corresponding to the second pixel into a fourth gray-scale value, wherein the third gray-scale value is larger than the first average gray-scale value, and the fourth gray-scale value is smaller than the first average gray-scale value; determine a fifth gray-scale value corresponding to a third pixel in a second pixel group and a sixth gray-scale value corresponding to a fourth pixel in the second pixel group, and determine a second average gray-scale value according to the fifth gray-scale value and the sixth gray-scale value; and modify the fifth gray-scale value corresponding to the third pixel in the second pixel group into a seventh gray-scale value, and modify the sixth gray-scale value corresponding to the fourth pixel in the second pixel group into an eighth gray-scale value, wherein the seventh gray-scale value is smaller than the second average gray-scale value, and the eighth gray-scale value is larger than the eighth gray-scale value; and control the MVA wide viewing angle liquid crystal screen to display the adjusted first frame and the adjusted second frame according to the display order.

DETAILED DESCRIPTION OF THE EMBODIMENTS

Some embodiments of the present disclosure will be described below in combination with the drawings.

Figure 1:
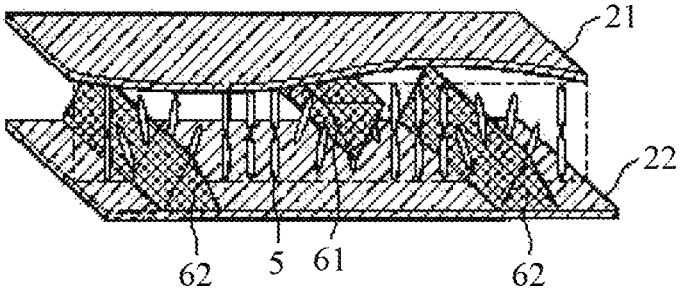
FIG. 1 is a schematic diagram of the principle of MVA technology.

As shown in FIG. 1, in MVA technology, a pixel is divided into multiple areas, liquid crystal molecules in each area deflect in a different direction after being applied with a voltage, so that the integral viewing angle of the pixel is expanded. In FIG. 1, reference no. 21 represents a color filer glass substrate, reference no. 22 represents a thin film transistor glass substrate, reference no. 61 represents a protruding structure on the color filer glass substrate, reference no. 62 represents a protruding structure on the thin film transistor glass substrate, and reference no. 5 represents a liquid crystal molecule. Due to the protruding structures, not all the liquid crystal molecules at a static state are vertical to the thin film transistor glass substrate or the color filer glass substrate, and the liquid crystal molecules, near the protruding structures, at the static state have certain inclination angles. In the MVA technology, each pixel includes multiple such protruding structures. When the voltage is applied to the liquid crystals, the liquid crystal molecules deflect in different directions, in this way, compensation in corresponding directions can be obtained, when observing the screen from different angles, namely, the viewing angle is perfected.

Figure 2:
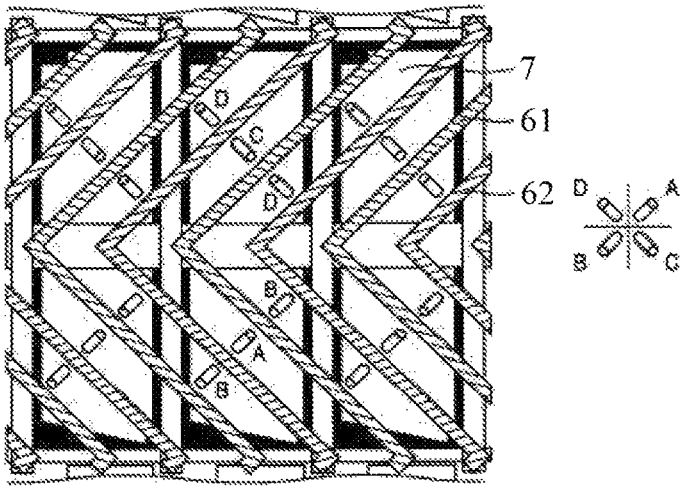
FIG. 2 is a schematic diagram of an inclination direction of liquid crystal molecules in a pixel structure in MVA technology.

In the MVA technology, the larger the number of sub-domains used in the pixels, the wider the viewing angle of the liquid crystal display screen, and each pixel may be in double-domain, four-domain, eight-domain, etc. As shown in FIG. 2, reference no. 7 represents a pixel electrode arranged on the thin film transistor glass substrate, reference no. 61 represents the protruding structure on the color filer glass substrate, and reference no. 62 represents the protruding structure on the thin film transistor glass substrate. One pixel is divided into three lengthwise areas (i.e. red, green, and blue areas), a gap area between the protruding structures is divided into four areas (i.e. A, B, C, and D areas), and the alignment directions of the liquid crystal molecules in the areas form 90 degree angles with each other. In this way, the liquid crystal molecules are arranged in multiple directions when the voltage is applied, and accordingly the viewing angle is expanded.

With the increase of the resolution of the liquid crystal display screen, the number of the pixels in the display screen is increased accordingly, and meanwhile, the sizes of the pixels are increasingly smaller. In a high-resolution liquid crystal display screen adopting the MVA technology, in order to obtain a larger display viewing angle, the number of the sub-domains in each pixel structure needs to be increased, and the number of electrode separators forming the sub-domains is increased accordingly. The electrode separators need to be covered by a black matrix, resulting in that the transparent area of each pixel is decreased accordingly, and the light transmittance of the entire liquid crystal display screen is correspondingly reduced. For example, the chroma viewing angle of a liquid crystal display screen adopting 8 sub-domains is 65% and the light transmittance is 4%, while the chroma viewing angle of a liquid crystal display screen adopting 4 sub-domains is only 40%, but the light transmittance thereof is increased to 5.3%.

In summary, in the liquid crystal display screen adopting the MVA technology, the increase of the viewing angle of the liquid crystal display screen and the increase of the light transmittance of the liquid crystal display screen are mutually contradictory, namely, the viewing angle of the liquid crystal display screen cannot be increased without changing the light transmittance of the liquid crystal display screen.

The method and device provided by some embodiments of the present disclosure can be applied to a liquid crystal display screen adopting the MVA technology, to increase the viewing angle of the liquid crystal display screen. In the liquid crystal display screen adopting the MVA technology to increase the viewing angle of the liquid crystal display screen, the viewing angle of the liquid crystal display screen is increased by increasing the number of the sub-domains in the pixel structure, but the light transmittance of the liquid crystal display screen is reduced, thus a method and device capable of increasing the viewing angle of the liquid crystal display screen without reducing the light transmittance of the liquid crystal display screen are needed. By applying the method and device provided by some embodiments of the present disclosure to the liquid crystal display screen adopting the MVA technology, the viewing angle of the liquid crystal display screen is increased without changing the light transmittance of the display screen.

The display method for the MVA wide viewing angle liquid crystal screen provided by some embodiments of the present disclosure may be operated by a display terminal (for example, a mobile phone, a tablet computer, a television or the like) including the MVA wide viewing angle liquid crystal screen, or may be a processor, an integrated circuit, or the like.

Figure 3:
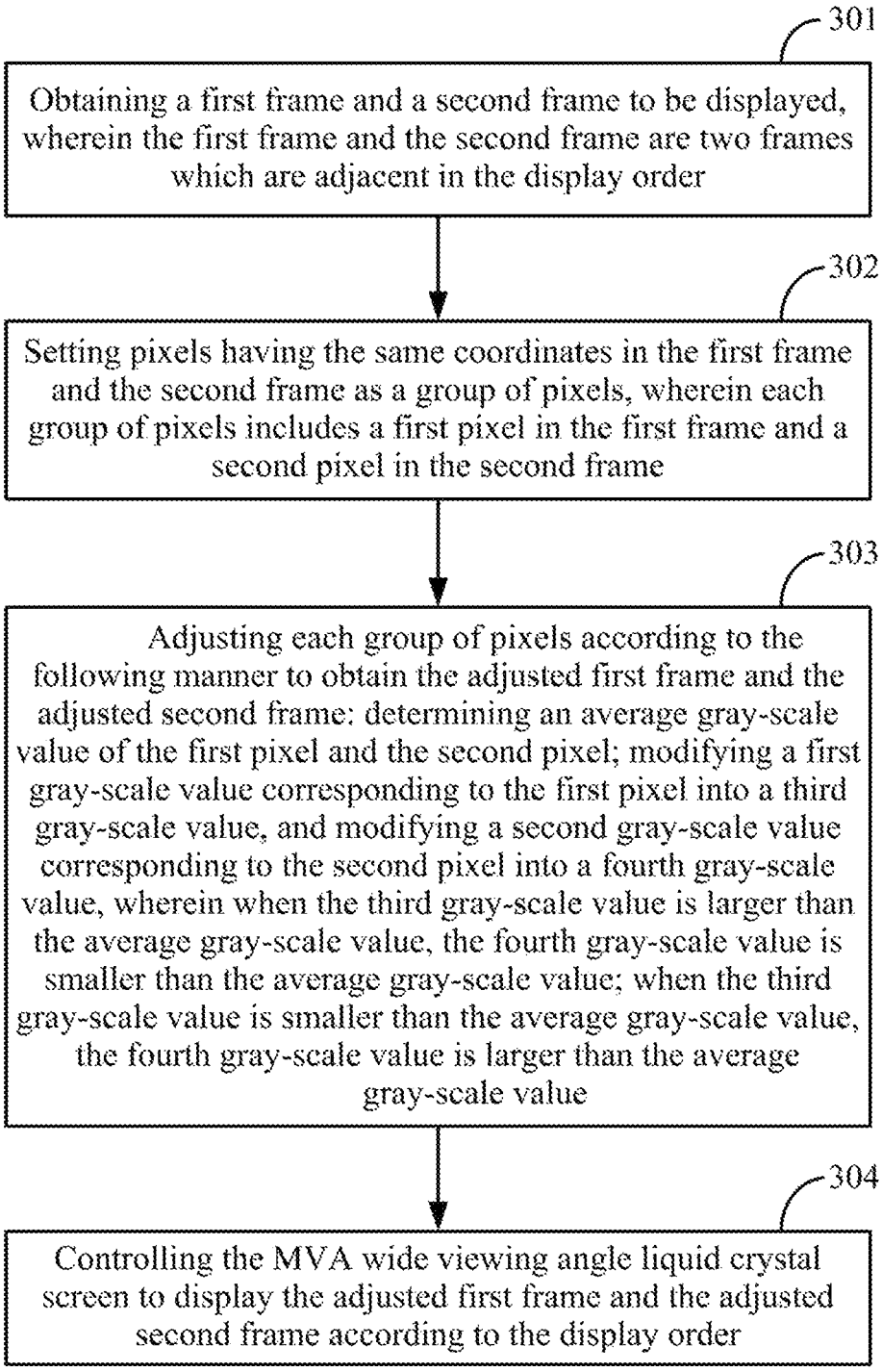
FIG. 3 is a flowchart of a display method applied to an MVA wide viewing angle liquid crystal screen provided by some embodiments of the present disclosure.

As shown in FIG. 3, a flowchart of a display method applied to an MVA wide viewing angle liquid crystal screen is provided by some embodiments of the present disclosure, and the method may include:

operation 301: obtaining a first frame and a second frame to be displayed, wherein the first frame and the second frame are two frames which are adjacent in the display order;

operation 302: setting pixels having the same coordinates in the first frame and the second frame as one group of pixels, wherein each group of pixels includes a first pixel in the first frame and a second pixel in the second frame;

operation 303: adjusting each group of pixels according to the following manner to obtain the adjusted first frame and the adjusted second frame:

determining an average gray-scale value of the first pixel and the second pixel; modifying a first gray-scale value corresponding to the first pixel into a third gray-scale value, and modifying a second gray-scale value corresponding to the second pixel into a fourth gray-scale value, wherein when the third gray-scale value is larger than the average gray-scale value, the fourth gray-scale value is smaller than the average gray-scale value; when the third gray-scale value is smaller than the average gray-scale value, the fourth gray-scale value is larger than the average gray-scale value; and operation 304: controlling the MVA wide viewing angle liquid crystal screen to display the adjusted first frame and the adjusted second frame according to the display order.

In operation 301, the obtained frames to be displayed are generally stored in a cache. The cache may be the cache of a central processor, the cache of a graphics processor or a single cache device, and embodiments of the present disclosure are not limited thereto. Multiple frames are generally stored in the cache and each frame is subject to the display order. In some embodiments of the present disclosure, the obtained frames to be displayed may be grouped, and each group may include at least two frames. For example, all the obtained frames to be displayed are grouped, each group of frames only includes the first frame and the second frame which are adjacent in the display order, and the frames contained in any group of frames are different from the frames contained in other groups of frames. The obtained first frame and the obtained second frame may be frames including J*K pixels, namely, including J rows and K columns of pixels, wherein J and K are positive integers. For example, each obtained frame includes 1280*720 or 1920*1080 pixels, etc.

After obtaining the first frame and the second frame which is adjacent to the first frame in the display order, the gray-scale value of each pixel in the first frame and the second frame can be determined, so as to determine the necessary gray-scale voltage of each pixel according to the gray-scale value of each pixel. The gray-scale value of each pixel is generally an arbitrary integer from 0 to 255 or an arbitrary integer from 0 to 1023, and may be determined according to the number of coding bits adopted by the gray-scale value corresponding to each pixel.

Since the received first frame and second frame are two frames which are adjacent in the display order, under normal circumstances, the gray-scale values of the pixels, in the first frame and the second frame, at the same position are close, and when the first frame and the second frame are continuously displayed, the gray-scale voltages obtained by the pixels at the same position are close too, resulting in that the deflection angles of liquid crystal molecules in the pixel structure of the liquid crystal display screen corresponding to the pixels at the same position are close. In order to increase the deflection angles of the liquid crystal molecules in the liquid crystal display screen, without increasing the number of sub-domains in the pixel structure of the liquid crystal display screen, in some embodiments of the present disclosure, after determining the gray-scale value corresponding to each pixel in the first frame and the second frame, the gray-scale value of each pixel in the first frame and the second frame may be modified, to increase the difference between the gray-scale value of the first pixel in the first frame and the gray-scale value of the second pixel having the same position, in the second frame as the first pixel, so as to increase the difference between the obtained gray-scale voltages, such that the difference between the deflection angles is increased when the liquid crystal molecules continuously deflect twice.

In some embodiments of the present disclosure, operations are performed for the pixels in each frame, after obtaining the first frame and the second frame which are adjacent in the display order, and the pixels in each group of frames can be grouped. In operation 302, for each group of frames, J*K groups of pixels are determined, each group of pixels includes the first pixel in the first frame in the group and the second pixel in the second frame in the group, and the coordinates of the first pixel in the first frame are the same as the coordinates of the second pixel in the second frame. The coordinates of the pixel refer to a relative position of the pixel in a frame of video and may be expressed in a variety of manners, for example, the coordinates of the first pixel on the $X^{th}$ row and the $Y^{th}$ column in the first frame are (X, Y), the coordinates of the second pixel, having the same coordinates as the first pixel in the second frame, are (X, Y), and the second pixel is located on the $X^{th}$ row and the $Y^{th}$ column in the second frame.

After obtaining the gray-scale values corresponding to each group of pixels of the first frame and the second frame in each group of frames, in operation 302, the average gray-scale value of each group of pixels can be determined, namely, the average gray-scale value of the first pixel in the first frame and the second pixel having the same coordinates as the first pixel in the second frame is determined.

In operation 303, each group of pixels may be processed, according to the average gray-scale value of each group of pixels determined in operation 302, for example, the first gray-scale value corresponding to the first pixel is modified into the third gray-scale value which is larger than the average gray-scale value, and the second gray-scale value corresponding to the second pixel is modified into the fourth gray-scale value which is smaller than the average gray-scale value.

When the first pixel in the first frame corresponds to the third gray-scale value, the obtained gray-scale voltage is larger than the gray-scale voltage obtained when the second pixel, in the second first frame, corresponding to the first pixel in the first frame corresponds to the fourth gray-scale value, resulting in that the difference between the deflection angles is increased, when the liquid crystal molecules in the liquid crystal display screen continuously deflect twice.

In order to modify the gray-scale values of the first pixel in the first frame and the second pixel in the second first frame, without resulting in severe distortion of the displayed frames, the third gray-scale value corresponding to the first pixel and the fourth gray-scale value corresponding to the second pixel need to be controlled within a reasonable range. In some embodiments of the present disclosure, the first gray-scale value and the third gray-scale value corresponding to the first pixel may be associated with the second gray-scale value and the fourth gray-scale value corresponding to the second pixel, to enable a finally displayed picture of the frames to be received by the audience. For example, the gray-scale values of the pixels may be associated according to the following manner: the average gray-scale value of the third gray-scale value corresponding to the first pixel and the fourth gray-scale value corresponding to the second pixel, is equal to the average gray-scale value of the first gray-scale value corresponding to the first pixel and the second gray-scale value corresponding to the second pixel. By means of this method, the variation of the gray-scale values of the pixels of the displayed picture of the frames is kept, within the range of the gray-scale values of the pixels of the original frames, in order to avoid picture distortion.

When displaying a frame of an image, a liquid crystal display may determine the gray-scale voltage corresponding to each gray-scale value, according to the gray-scale value corresponding to each pixel in the image to be displayed, to enable the liquid crystal molecules in the liquid crystal display to deflect to a certain degree and generate specific light transmittance, so as to display the frame of the image. The gray-scale voltage corresponding to the gray-scale value of each pixel may be adjusted, and the gray-scale voltage corresponding to the gray-scale value may be adjusted, by adjusting a gamma value in a gamma circuit in the liquid crystal display. Under the condition of different gamma values, the same gray-scale value corresponds to different gray-scale voltages. Meanwhile, under the condition that all components of the liquid crystal display are definite, the gray-scale value corresponding to a pixel has a mathematical corresponding relation with the light transmittance corresponding to the pixel, and the mathematical expression of the corresponding relation between the gray-scale value and the light transmittance of each pixel is:

$$T_n^\gamma = k\left(\frac{n}{M}\right)^\gamma + L,$$

wherein n represents the gray-scale value corresponding to a pixel, $T_n^\gamma$ represents the light transmittance when the gray-scale value is n, M represents the maximum value of the gray-scale value corresponding to the pixel and is generally 255, 1023 or the like, γ represents the gamma value, k represents the coefficient of the light transmittance and generally is 1, and L represents the light transmittance when the gray-scale value corresponding to the pixel is 0, and generally L is equal to 0. Therefore, the above formula may be simplified to $$T_n^\gamma = \left(\frac{n}{M}\right)^\gamma.$$

When γ is a specific numerical value, for example γ is 2.2, the gray-scale voltage and the light transmittance corresponding to each gray-scale value can be determined.

In some embodiments of the present disclosure, when the first frame and the second frame are displayed, the first frame is displayed at first, and then the second frame is displayed. When the first frame is displayed, the first frame is displayed according to the third gray-scale value of the first pixel in the first frame, and when the second frame is displayed, the second frame is displayed according to the fourth gray-scale value of the second pixel in the second frame.

The first frame and the second frame may be displayed by using the same gamma value, according to the above description, the gray-scale voltage corresponding to each pixel with the definite gamma value may be determined, according to the gray-scale value corresponding to each pixel at this time, and accordingly the first frame and the second frame are displayed, according to the gray-scale voltage corresponding to each pixel in the first frame and the second frame.

When the first frame and the second frame are displayed, the gray-scale value corresponding to each pixel is modified, so that the light transmittance corresponding to each pixel changes as well, and in order to avoid too large loss of brightness of two entire frames of images displayed when the first frame and the second frame are displayed, the gamma value corresponding to the first frame and the gamma value corresponding to the second frame need to be optimized. For example, the sum of the first light transmittance, corresponding to the first pixel in the first frame, and the second light transmittance, corresponding to the second pixel in the second frame, is twice as large as the third light transmittance corresponding to the average gray-scale value of the first pixel and the second pixel. Meanwhile, before displaying each group of frames, the gamma values corresponding to the first frame and the second frame in each group of frames need to be determined. To reduce the calculation complexity, the first frame in each group of frames adopts a preset first gamma value, and at this time, the corresponding gray-scale voltage of the first pixel in the first frame is determined according to the same first gamma value. Meanwhile, a third gamma value is set for the average gray-scale value of the first gray-scale value, corresponding to the first pixel, and the second gray-scale value corresponding to the second pixel. Both of the first gamma value and the third gamma value are preset values and can be determined according to practical conditions. For example, the third gamma value may be preset to be 2.2 and the first gamma value is preset to be a value smaller than 2.2. Before displaying the second pixel in the second frame, the second light transmittance of the second pixel may be determined, according to the first light transmittance of the first pixel corresponding to the second pixel, and the third light transmittance corresponding to the average gray-scale value of the first gray-scale value corresponding to the first pixel, and the second gray-scale value corresponding to the second pixel, then the second gamma value of the fourth gray-scale value corresponding to the second pixel with the second light transmittance is determined, according to the formula of the light transmittance and the gray-scale value, and finally, when the second pixel corresponds to the fourth gray-scale value, the gray-scale voltage is determined according to the second gamma value.

For example, the first gray-scale value corresponding to the first pixel on the $X^{th}$ row and the $Y^{th}$ column in the first frame is 110, and the second gray-scale value corresponding to the second pixel on the $X^{th}$ row and the $Y^{th}$ column in the second frame is 90, at this time, the average gray-scale value of the first gray-scale value corresponding to the first pixel and the second gray-scale value corresponding to the second pixel is 100; and then the first gray-scale value corresponding to the first pixel on the $X^{th}$ row and the $Y^{th}$ column in the first frame is modified into the third gray-scale value 135, and the second gray-scale value corresponding to the second pixel on the $X^{th}$ row and the $Y^{th}$ column in the second frame is modified into the fourth gray-scale value 65. When it is determined that the first pixel corresponds to the third gray-scale value 135, the corresponding first light transmittance under the first gamma value $\gamma_1$ is $$T_{135}^{\gamma_1} = \left(\frac{135}{255}\right)^{\gamma_1}.$$

Figure 4:
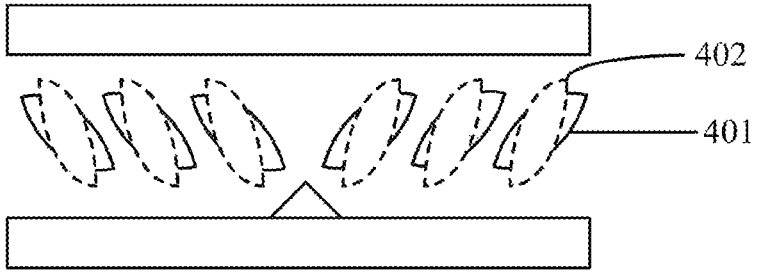
FIG. 4 and FIG. 5 are schematic diagrams of deflection of liquid crystal molecules provided by some embodiments of the present disclosure.

At this time, the schematic diagram of the deflection of the liquid crystal molecules, when the first pixel is displayed at the third gray-scale value can be shown by a solid line 401 in FIG. 4. A dotted line 402 in FIG. 4 is the schematic diagram of the deflection of the liquid crystal molecules, when the first pixel is displayed at the first gray-scale value. It can be seen from FIG. 4 that the deflection angles of the liquid crystal molecules are obviously increased, when the first pixel is displayed at the third gray-scale value. Meanwhile, the average gray-scale value of the first gray-scale value corresponding to the first pixel and the second gray-scale value corresponding to the second pixel is determined to be 100, and the corresponding first light transmittance with the third gamma value $\gamma_3$ is $$T_{100}^{\gamma_3} = \left(\frac{100}{255}\right)^{\gamma_3}.$$

At this time, when it can be determined that the second pixel is at the fourth gray-scale value 65, the corresponding second light transmittance is $T_{65}^{\gamma_2}=2*T_{100}^{\gamma_3}-T_{135}^{\gamma_1}$. When the second pixel corresponds to the fourth gray-scale value 65, the corresponding second gamma value $\gamma_2$ is determined, according to the formula of the light transmittance and the gray-scale value $$T_n^{\gamma} = \left(\frac{n}{M}\right)^{\gamma}.$$

Figure 5:
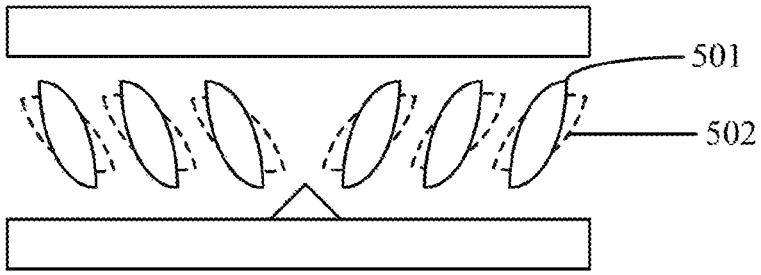

At this time, when the second pixel is displayed at the fourth gray-scale value, the schematic diagram of the deflection of the liquid crystal molecules can be shown by a solid line 501 in FIG. 5. A dotted line 502 in FIG. 5 is the schematic diagram of the deflection of the liquid crystal molecules, when the second pixel is displayed at the second gray-scale value. It can be seen from FIG. 5 that the deflection angles of the liquid crystal molecules are obviously decreased, when the second pixel is displayed at the second gray-scale value.

In combination of FIG. 4 and FIG. 5, it can be seen that the difference between the deflection angles of the liquid crystal molecules when the first pixel in each group of pixels is displayed and the deflection angles of the liquid crystal molecules when the second pixel is displayed is increased, so that when the first frame and the second frame are continuously displayed within a short time, the axes of more liquid crystal molecules can be observed by a user from the same viewing angle, and thus the display viewing angle of the liquid crystal display screen is improved.

It can be seen from the above description that, the first gamma value corresponding to the first frame aims at each first pixel in the first frame, namely, the first gamma value corresponding to each first pixel in the first frame is the same. Similarly, the third gamma value, corresponding to the average gray-scale value of the first gray-scale value corresponding to the first pixel and the second gray-scale value corresponding to the second pixel, is invariable. While the second gamma value corresponding to each second pixel in the second frame is not necessarily the same, and the second gamma value corresponding to each second pixel needs to be calculated according to practical conditions. In operation 304, when the first pixel in the first frame corresponds to the third gray-scale value, the gray-scale voltage may be firstly determined according to the first gamma value, and the MVA wide viewing angle liquid crystal screen is controlled, to display the first frame, according to the gray-scale voltage when the first pixel corresponds to the third gray-scale value, and when the second pixel corresponds to the fourth gray-scale value, the gray-scale voltage is determined according to the second gamma value corresponding to the second pixel in the second frame, and the MVA wide viewing angle liquid crystal screen is controlled, to display the second pixel, according to the gray-scale voltage when the second pixel corresponds to the fourth gray-scale value.

In the liquid crystal display, since light entering human eyes need to pass through the liquid crystal molecules, the liquid crystal molecules are anisotropic substances, and the refractive indexes along the long axis direction and the short axis direction are inconsistent. When viewing the screen from different angles, the user sees the long axes of the liquid crystal molecules sometimes and sees the short axes sometimes. When the user sees the long axes of the liquid crystal molecules, a picture with higher brightness can be obtained, and when the user sees the short axes of the liquid crystal molecules, the brightness of the seen picture is so low that the picture displayed in the liquid crystal display cannot be seen clearly. In order to obtain a larger viewing angle when displaying the image to be displayed, in some embodiments of the present disclosure, all the obtained frames to be displayed are grouped, each group of frames only includes the first frame and the second frame which are adjacent in the display order, and the frames contained in any group of frames are different from the frames contained in other groups of frames. Meanwhile, the first gray-scale value corresponding to the first pixel in the first frame is modified into the third gray-scale value, and the second gray-scale value corresponding to the second pixel is modified into the fourth gray-scale value. When displaying the first image to be displayed, the gray-scale voltage, obtained by the first pixel in the first frame, is larger than the gray-scale voltage obtained by the second pixel in the second frame having the same coordinates as the first pixel in the first frame, so that the difference between the deflection directions of the liquid crystal molecules is increased. When the first frame and the second frame are continuously displayed within a short time, due to the afterglow effect of human eyes, the user observes the axes of more liquid crystal molecules from the same viewing angle, and thus the viewing angle is improved.

According to the method described above, the gray-scale values of two pixels, having the same coordinates in the two frames which are adjacent in the display order, can be modified, to increase the gray-scale values of the pixels of the first frame and decrease the gray-scale values of the pixels of the second frame, so that when the first frame and the second frame are displayed, the liquid crystal molecules obtain different deflection angles. Meanwhile, in order to avoid larger loss of the light transmittance after the two pixels having the same coordinates in the two adjacent frames are displayed, the first frame is displayed at the fixed first gamma value, and the second gamma value used to display the second frame is determined via the first gamma value, such that the light transmittance is kept at a certain value, when the two pixels having the same coordinates in the two frames which are adjacent in the display order are displayed. Since the second gamma value used by each pixel in the second frame needs to be calculated in real time, this may cause time delay effect and other influences on the display of the frames. Thus, in some embodiments of the present disclosure, the first frame and the second frame are provided with different gamma values, to increase the display wide angle of the liquid crystal display screen, and reference can be made to the following descriptions.

Figure 6:
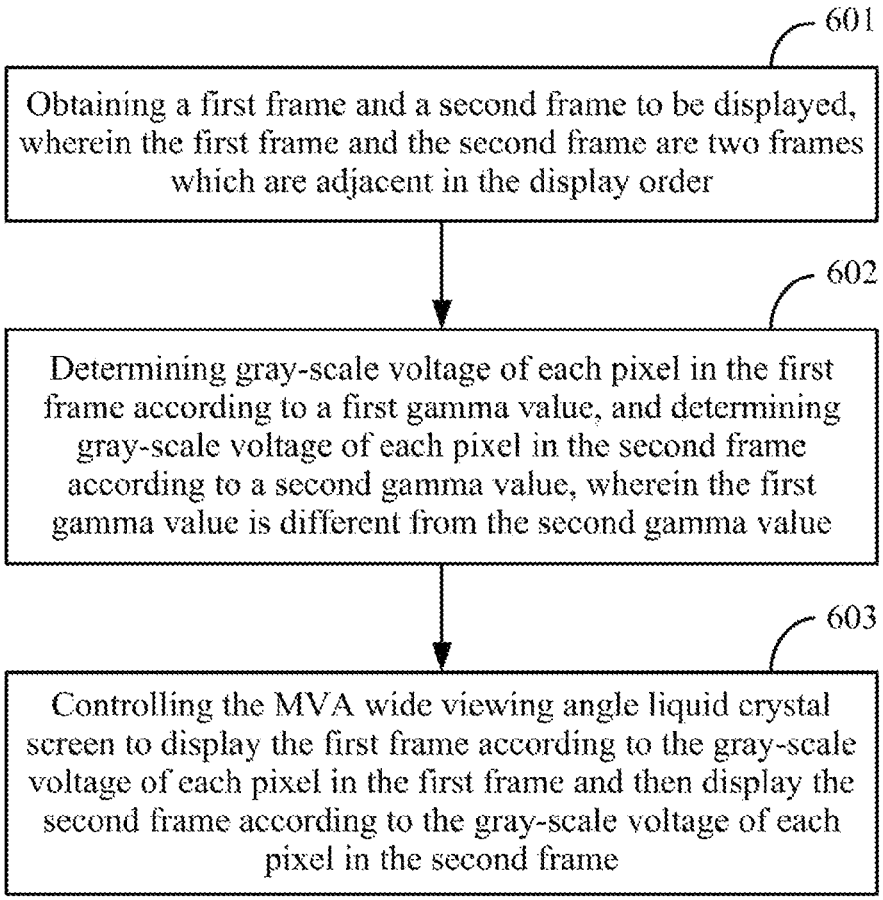
FIG. 6 is a flowchart of another display method applied to an MVA wide viewing angle liquid crystal screen provided by some embodiments of the present disclosure.

As shown in FIG. 6, some embodiments of the present disclosure further provide a display method applied to an MVA wide viewing angle liquid crystal screen, including:

operation 601: obtaining a first frame and a second frame to be displayed, wherein the first frame and the second frame are two frames which are adjacent in the display order;

operation 602: determining the gray-scale voltage of each pixel in the first frame according to a first gamma value, and determining the gray-scale voltage of each pixel in the second frame according to a second gamma value, wherein the first gamma value is different from the second gamma value; and operation 603: controlling the MVA wide viewing angle liquid crystal screen to display the first frame, according to the gray-scale voltage of each pixel in the first frame, and then display the second frame according to the gray-scale voltage of each pixel in the second frame.

For example, with respect to ten received frames which are adjacent in the display order, when the first frame is displayed, the gray-scale voltages corresponding to the pixels in the first frame are determined by adopting the first gamma value, when the second frame is displayed, the gray-scale voltages corresponding to the pixels in the second frame are determined by adopting the second gamma value, when the third frame is displayed, the gray-scale voltages corresponding to the pixels in the third frame are determined by adopting the first gamma value, when the fourth frame is displayed, the gray-scale voltages corresponding to the pixels in the fourth frame are determined by adopting the second gamma value, and when the other frames are displayed, the gamma values are adopted in a similar way.

The first gamma value is unequal to the second gamma value. Optionally, one of the first gamma value and the second gamma value is larger than a preset gamma value and the other is smaller than the preset gamma value. The first gamma value may be larger than the preset gamma value and the second gamma value is smaller than the preset gamma value, or the second gamma value is larger than the preset gamma value and the first gamma value is smaller than the preset gamma value. The preset gamma value is generally 2.2 or other preset values.

The above description involves dividing every two of all the obtained frames to be displayed into a group, but every four of all the obtained frames to be displayed may form a group as well.

For example, all the obtained frames to be displayed are grouped, each group of frames includes a first frame, a second frame, a third frame, and a fourth frame, which are adjacent in the display order, and the frames contained in any group of frames are different from the frames contained in other groups of frames. When the first pixel in the first frame corresponds to the first gray-scale value, the corresponding gray-scale voltage is determined according to the first gamma value, when the second pixel in the second frame corresponds to the second gray-scale value, the corresponding gray-scale voltage is determined according to the second gamma value, when the third pixel in the third frame corresponds to the third gray-scale value, the corresponding gray-scale voltage is determined according to the second gamma value, and when the fourth pixel in the fourth frame corresponds to the fourth gray-scale value, the corresponding gray-scale voltage is determined according to the first gamma value. Finally, each frame is displayed according to the gray-scale voltage corresponding to each pixel in each frame.

Figure 7:
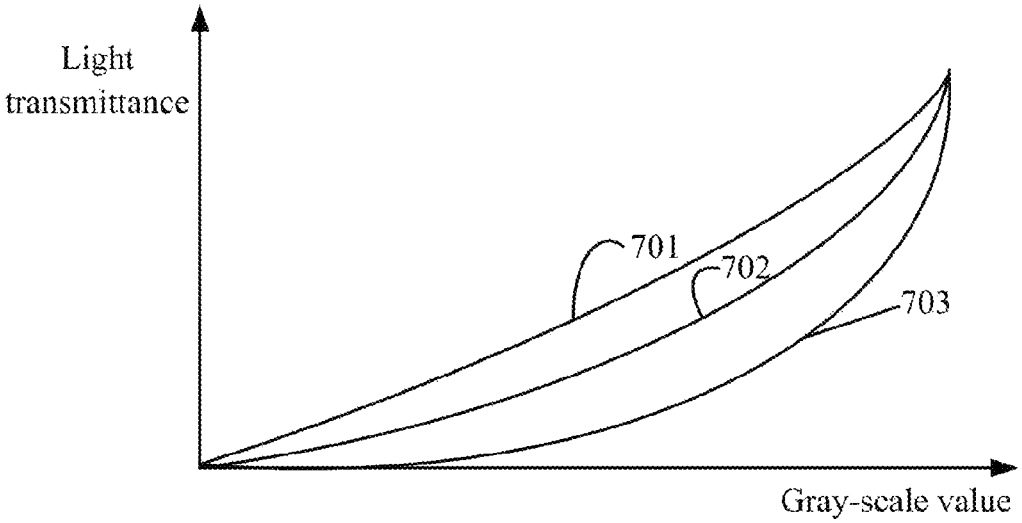
FIG. 7 is a schematic diagram of a corresponding relation between a gray-scale value and light transmittance provided by some embodiments of the present disclosure.

For example, as shown in FIG. 7, a curve of the gray-scale values and the light transmittance corresponding to the first gamma value is 701, a curve of the gray-scale values and the light transmittance corresponding to the second gamma value is 703, and a curve of the gray-scale values and the light transmittance corresponding to the preset gamma value is 702. With respect to 8 received frames which are adjacent in the display order, when the first frame is displayed, the gray-scale voltages corresponding to the pixels in the first frame are determined by adopting the first gamma value, and the curve of the gray-scale values and the light transmittance corresponding to the pixels is 701. When the second frame is displayed, the gray-scale voltages corresponding to the pixels in the second frame are determined by adopting the second gamma value, and the curve of the gray-scale values and the light transmittance corresponding to the pixels is 703. At this time, it can be seen from FIG. 7 that when the pixels having the same coordinates in the first frame and the second frame are displayed, the difference of the corresponding light transmittance is larger, which means that the difference of the deflection angles of the corresponding liquid crystal molecules is larger, so that the display viewing angle is compensated, to enable the liquid crystal display to obtain a larger display viewing angle. When the third frame is displayed, the gray-scale voltages corresponding to the pixels in the third frame are determined by adopting the second gamma value, and the curve of the gray-scale values and the light transmittance corresponding to the pixels is 703. When the fourth frame is displayed, the gray-scale voltages corresponding to the pixels in the fourth frame are determined by adopting the first gamma value, and the curve of the gray-scale values and the light transmittance corresponding to the pixels is 701. When the other frames are displayed, the adoption of the gamma values for each frame in each group can refer to the above description, which will not be repeated redundantly herein.

In addition, all the obtained frames to be displayed may also be divided in other grouping manners, and the specific implementation manner of each grouping manner may refer to the above description, which will not be repeated redundantly herein.

To achieve a better effect, when the first frame and the second frame are displayed, the gray-scale voltages corresponding to the gray-scale values of adjacent pixels in the first frame and the second frame may be set to be different, so that an inverse size relation of the gray-scale voltages of the adjacent pixels is formed, resulting in an inverse size relation of the light transmittance of the adjacent pixels and forming light transmittance compensation in space.

Figure 8:
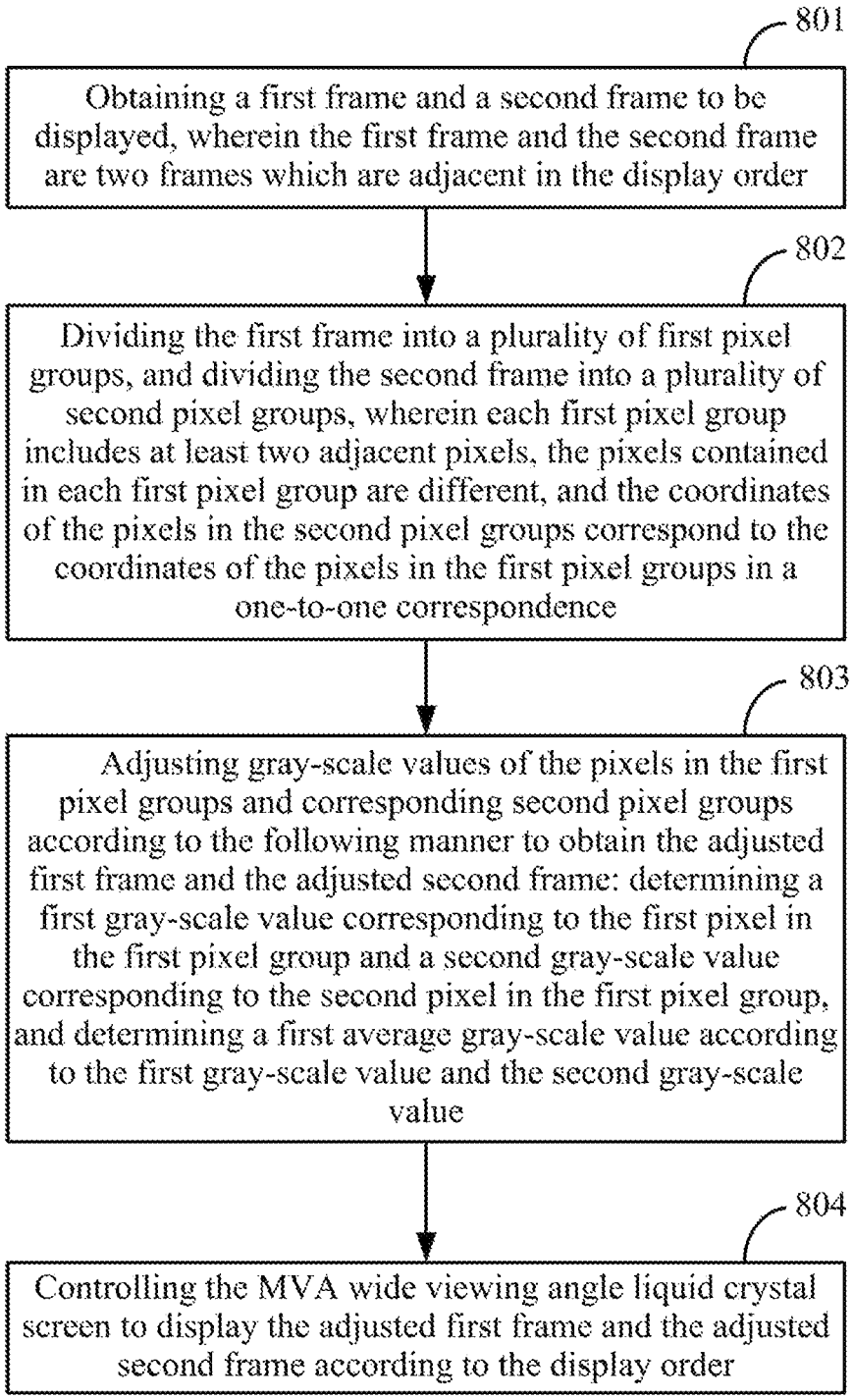
FIG. 8 is a flowchart of another display method applied to an MVA wide viewing angle liquid crystal screen provided by some embodiments of the present disclosure.

As shown in FIG. 8, some embodiments of the present disclosure further provide a display method applied to an MVA wide viewing angle liquid crystal screen, and the method can include:

operation 801: obtaining a first frame and a second frame to be displayed, wherein the first frame and the second frame are two frames which are adjacent in the display order;

operation 802: dividing the first frame into multiple first pixel groups, and dividing the second frame into multiple second pixel groups, wherein each first pixel group includes at least two adjacent pixels, the pixels contained in each first pixel group are different, and the coordinates of the pixels in the second pixel groups correspond to the coordinates of the pixels in the first pixel groups in a one-to-one correspondence;

operation 803: adjusting gray-scale values of the pixels in the first pixel groups and corresponding second pixel groups, according to the following manner to obtain the adjusted first frame and the adjusted second frame:

determining a first gray-scale value corresponding to the first pixel in the first pixel group and a second gray-scale value corresponding to the second pixel in the first pixel group, and determining a first average gray-scale value according to the first gray-scale value and the second gray-scale value;

modifying the first gray-scale value corresponding to the first pixel in the first pixel group into a third gray-scale value, and modifying the second gray-scale value corresponding to the second pixel into a fourth gray-scale value, wherein the third gray-scale value is larger than the first average gray-scale value, and the fourth gray-scale value is smaller than the first average gray-scale value;

determining a fifth gray-scale value corresponding to a third pixel in the second pixel group and a sixth gray-scale value corresponding to a fourth pixel in the second pixel group, and determining a second average gray-scale value according to the fifth gray-scale value and the sixth gray-scale value;

modifying the fifth gray-scale value corresponding to the third pixel in the second pixel group into a seventh gray-scale value, and modifying the sixth gray-scale value corresponding to the fourth pixel in the second pixel group into an eighth gray-scale value, wherein the seventh gray-scale value is smaller than the second average gray-scale value, and the eighth gray-scale value is larger than the eighth gray-scale value; and operation 804: controlling the MVA wide viewing angle liquid crystal screen to display the adjusted first frame and the adjusted second frame according to the display order.

After obtaining the frames to be displayed, all the obtained frames to be displayed are grouped, each group of frames includes the first frame and the second frame which are adjacent in the display order, and the frames contained in any group of frames are different from the frames contained in other groups of frames.

For each group of frames, the pixels in the first frame are divided into multiple first pixel groups, and each pixel group includes different pixels. The pixels in the second frame are divided into multiple second pixel groups, and each pixel group includes different pixels. For example, the pixels on the $X^{th}$ row and the $Y^{th}$ column and on the $X^{th}$ row and the $(Y+1)^{th}$ column in the first frame are divided as the first pixel group, and the pixels on the $X^{th}$ row and the $Y^{th}$ column and on the $X^{th}$ row and the $(Y+1)^{t}$ column in the second frame are divided as the second pixel group. The first gray-scale value corresponding to the first pixel on the $X^{th}$ row and the $Y^{th}$ column in the first frame and the second gray-scale value corresponding to the second pixel on the $X^{th}$ row and the $(Y+1)^{th}$ column in the first frame are determined, and the first average gray-scale value of the first gray-scale value corresponding to the first pixel on the $X^{th}$ row and the $Y^{th}$ column and the second gray-scale value corresponding to the first pixel on the $X^{th}$ row and the $(Y+1)^{th}$ column is determined;

the first gray-scale value corresponding to the first pixel on the $X^{th}$ row and the $Y^{th}$ column in the first frame is modified into the third gray-scale value, and the third gray-scale value is larger than the first average gray-scale value, and the second gray-scale value corresponding to the second pixel is modified into the fourth gray-scale value, and the fourth gray-scale value is smaller than the first average gray-scale value;

the fifth gray-scale value corresponding to the third pixel on the $X^{th}$ row and the $Y^{th}$ column in the second frame and the sixth gray-scale value corresponding to the fourth pixel on the $X^{th}$ row and the $(Y+1)^{th}$ column in the second frame are determined, and the second average gray-scale value of the fifth gray-scale value corresponding to the third pixel on the $X^{th}$ row and the $Y^{th}$ column and the sixth gray-scale value corresponding to the pixel on the $X^{th}$ row and the $(Y+1)^{th}$ column is determined; and the fifth gray-scale value corresponding to the third pixel on the $X^{th}$ row and the $Y^{th}$ column in the second frame is modified into the seventh gray-scale value, and the seventh gray-scale value is smaller than the second average gray-scale value, and the sixth gray-scale value corresponding to the fourth pixel is modified into the eighth gray-scale value, and the eighth gray-scale value is larger than the second average gray-scale value.

The above operations are carried out on the pixels of each first pixel group in the first frame, the above operations are carried out on the pixels of each second pixel group in the second frame, and finally the first frame and the second frame with the adjusted gray-scale values of the pixels are displayed according to the display order.

Figure 9A:
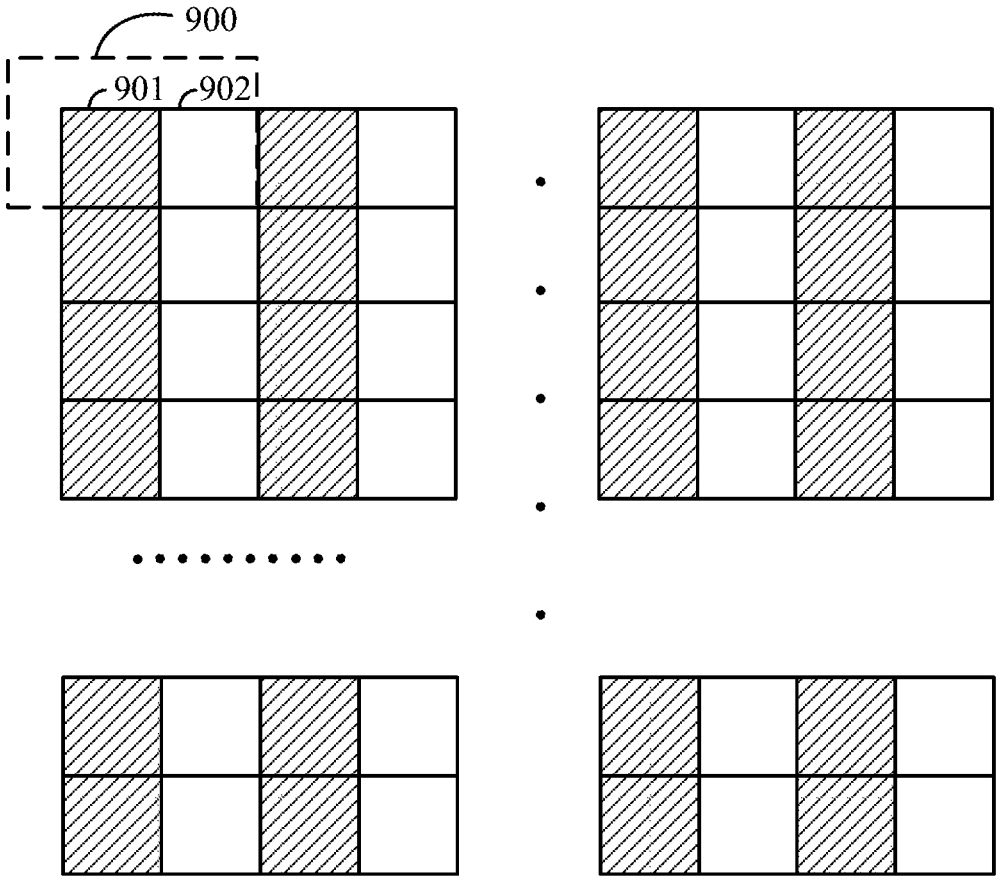
FIG. 9A to FIG. 9D are schematic diagrams of division of pixel groups in a frame provided by some embodiments of the present disclosure.
Figure 9B:
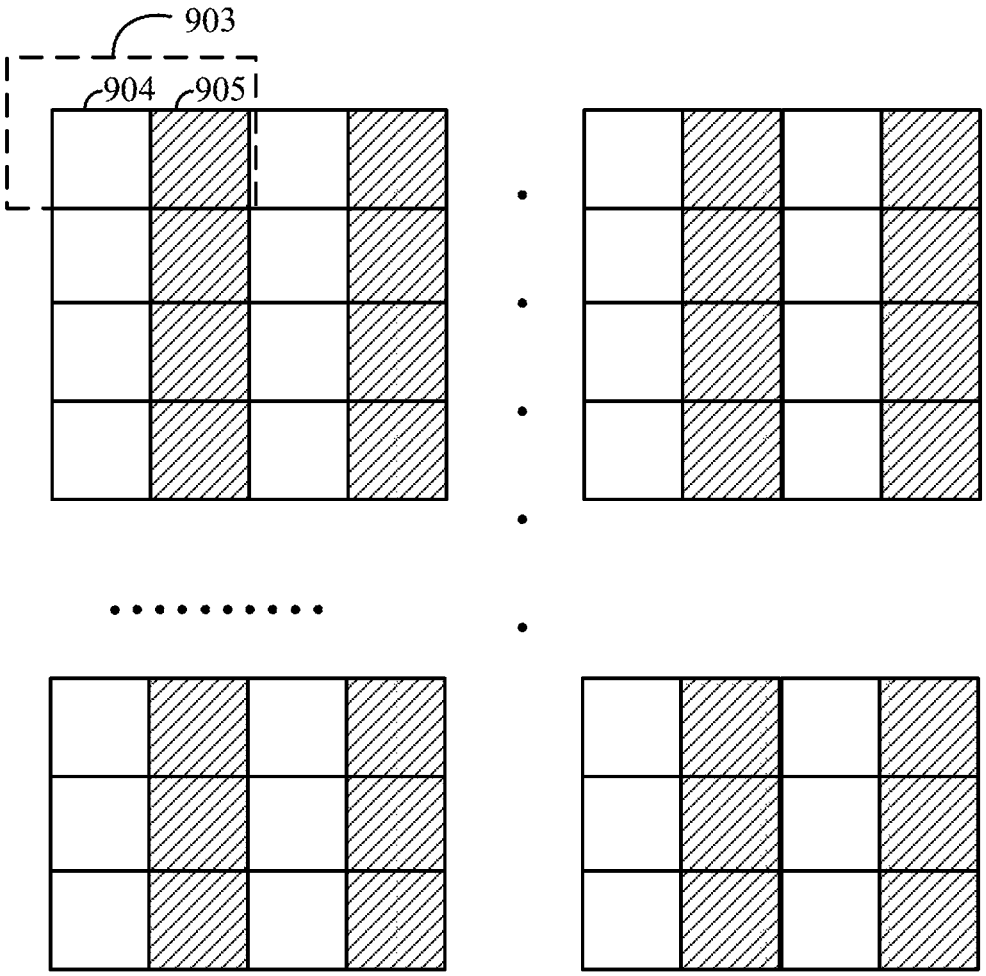

For example, as shown in FIG. 9A, the first frame may be divided into multiple first pixel groups 900, and each first pixel group 900 is composed of at least two adjacent pixels, which are respectively a first pixel 901 and a second pixel 902. Correspondingly, as shown in FIG. 9B, the second frame may be divided into multiple second pixel groups 903, each second pixel group 903 is composed of at least two adjacent pixels, which are respectively a pixel 904 and a pixel 905, wherein the coordinates of the pixel 904 are the same as the coordinates of the pixel 901 in the first frame, and the coordinates of the pixel 905 are the same as the coordinates of the pixel 902 in the first frame. The first gray-scale value corresponding to the first pixel 901 in the first pixel group 900 is modified into the third gray-scale value, the second gray-scale value corresponding to the second pixel 902 is modified into the fourth gray-scale value, the fifth gray-scale value corresponding to the third pixel 904 in the second pixel group 903 is modified into the seventh gray-scale value, and the sixth gray-scale value corresponding to the fourth pixel 905 in the second pixel group 903 is modified into the eighth gray-scale value. The gray-scale values of the pixels of each first pixel group 900 in the first frame and each second pixel group 903 in the second frame are modified according to the above method, and finally the first frame and the second frame with the adjusted gray-scale values of the pixels are displayed according to the display order, to mutually associate the first frame and the second frame. The similarity of the gray-scale values of the first frame and the second frame with high original similarity of the gray-scale values of pixels is reduced, so that when the first frame and the second frame are displayed, the difference between the gray-scale voltages obtained by the corresponding pixels is increased, and the deflection angles of the liquid crystal molecules are increased accordingly to compensate the display viewing angle of the liquid crystal display.

In the above description, each first pixel group in the first frame and each second pixel group in the second frame include two pixels. To achieve a better display effect, the first pixel group may include at least four pixels, and the second pixel group may include at least four pixels. For example, the pixels in the first frame are divided into multiple first pixel groups, and each pixel group includes different pixels, and the pixels in the second frame are divided into multiple second pixel groups, and each pixel group includes different pixels. For example, the pixels on the $X^{th}$ row and the $Y^{th}$ column, the $X^{th}$ row and the $(Y+1)^{th}$ column, the $(X+1)^{th}$ row and the $Y^{th}$ column and the $(X+1)^{th}$ row and the $(Y+1)^{th}$ column in the first frame are divided as the first pixel group, and the gray-scale values corresponding to the pixels in the first pixel group are determined as a, b, c, and d respectively. The pixels on the $X^{th}$ row and the $Y^{th}$ column, the $X^{th}$ row and the $(Y+1)^{th}$ column, the $(X+1)^{th}$ row and the $Y^{th}$ column and the $(X+1)^{th}$ row and the $(Y+1)^{th}$ column in the second frame are divided as the second pixel group, and the gray-scale values corresponding to the pixels in the first pixel group are determined as e, f, g, and h respectively.

Then, the gray-scale values of the pixels in each first pixel group in the first frame are modified, and the gray-scale values of the pixels in each second pixel group in the second frame are modified, and the specific method is as follows: respectively modifying the gray-scale values of the pixels on the $X^{th}$ row and the $Y^{th}$ column, the $X^{th}$ row and the $(Y+1)^{th}$ column, the $(X+1)^{th}$ row and the $Y^{th}$ column and the $(X+1)^{th}$ row and the $(Y+1)^{th}$ column in the first frame into a', b', c', and d', a' is larger than a, b' is smaller than b, a'+b' is equal to a+b, c' is smaller than c, d' is larger than d, and c'+d' is equal to c+d; respectively modifying the gray-scale values of the pixels on the $X^{th}$ row and the $Y^{th}$ column, the $X^{th}$ row and the $(Y+1)^{th}$ column, the $(X+1)^{th}$ row and the $Y^{th}$ column and the $(X+1)^{th}$ row and the $(Y+1)^{th}$ column in the second frame into e', f, g', and h', e' is smaller than e, f is larger than f, e'+f' is equal to e+f, g' is larger than g, h' is smaller than h, and g'+h' is equal to g+h.

Figure 9C:
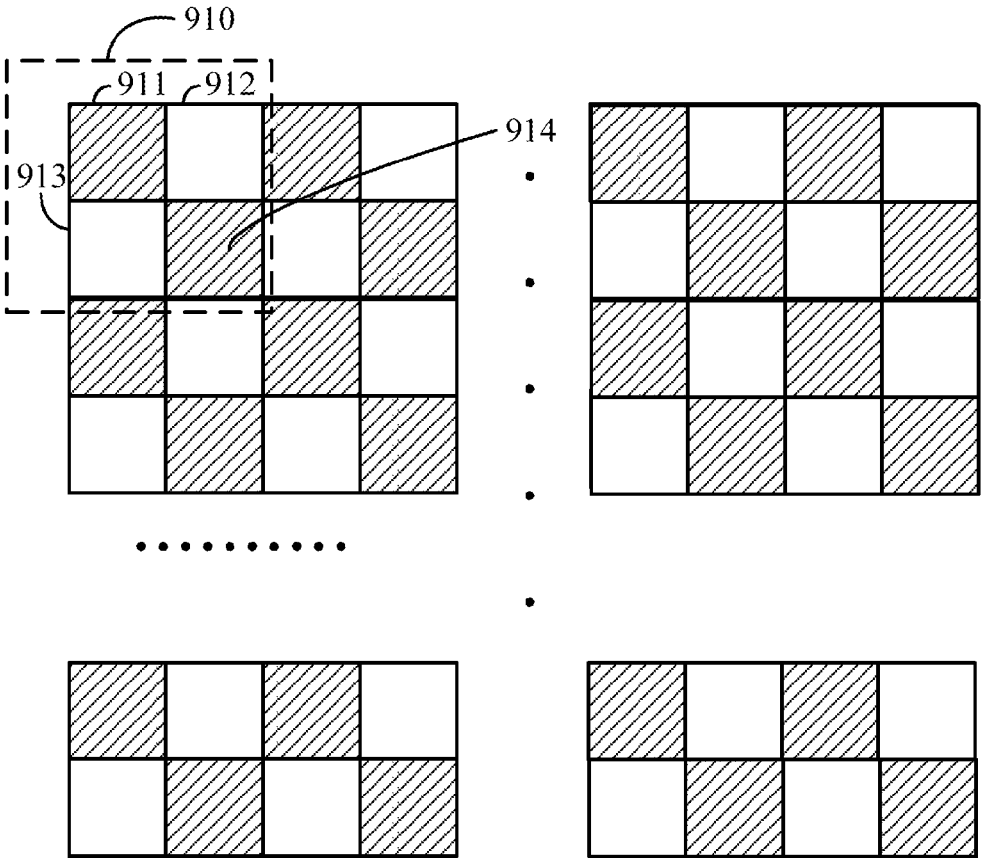
Figure 9D:
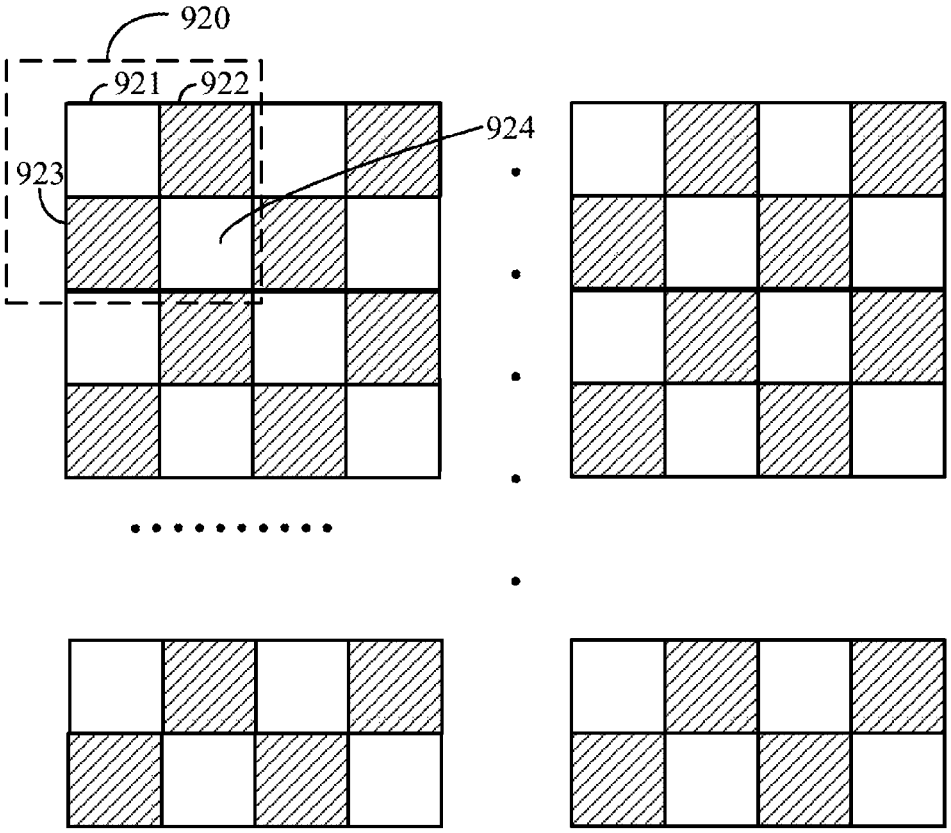

For example, as shown in FIG. 9C, the first frame may be divided into multiple first pixel groups 910, and each first pixel group 910 is composed of 2*2 pixels, which are respectively a first pixel 911, a second pixel 912, a fifth pixel 913, and a sixth pixel 914. Correspondingly, as shown in FIG. 9D, the second frame may be divided into multiple second pixel groups 920, and each second pixel group 920 is composed of 2*2 pixels, which are respectively a third pixel 921, a fourth pixel 922, a seventh pixel 923, and an eighth pixel 924, wherein the coordinates of the third pixel 921 and the first pixel 911 are the same, the coordinates of the fourth pixel 922 and the second pixel 912 are the same, the coordinates of the seventh pixel 923 and the fifth pixel 913 are the same, and the coordinates of the eighth pixel 924 and the sixth pixel 914 are the same. Then, the first average gray-scale value of the first pixel 911 and the second pixel 912 and the third average gray-scale value of the fifth pixel 913 and the sixth pixel 914 are determined, and the second average gray-scale value of the third pixel 921 and the fourth pixel 922 and the fourth average gray-scale value of the seventh pixel 923 and the eighth pixel 924 are determined. The gray-scale value corresponding to the first pixel 911 is modified into the third gray-scale value larger than the first average gray-scale value, the gray-scale value corresponding to the second pixel 912 is modified into the fourth gray-scale value smaller than the first average gray-scale value, the gray-scale value corresponding to the fifth pixel 913 is modified into the ninth gray-scale value smaller than the third average gray-scale value, and the gray-scale value corresponding to the sixth pixel 914 is modified into the tenth gray-scale value larger than the third average gray-scale value. The gray-scale value corresponding to the third pixel 921 is modified into the third gray-scale value smaller than the second average gray-scale value, the gray-scale value corresponding to the fourth pixel 922 is modified into the fourth gray-scale value larger than the second average gray-scale value, the gray-scale value corresponding to the seventh pixel 923 is modified into the eleventh gray-scale value larger than the fourth average gray-scale value, and the gray-scale value corresponding to the eighth pixel 924 is modified into the twelfth gray-scale value smaller than the fourth average gray-scale value.

Finally, the first frame and the second frame with the adjusted gray-scale values of the pixels are displayed according to the display order.

Aiming at the above method flows, some embodiments of the present disclosure further provide a display device applied to an MVA wide viewing angle liquid crystal screen, and the contents of the device may be implemented with reference to the above method, which will not be repeated redundantly herein.

Figure 10:
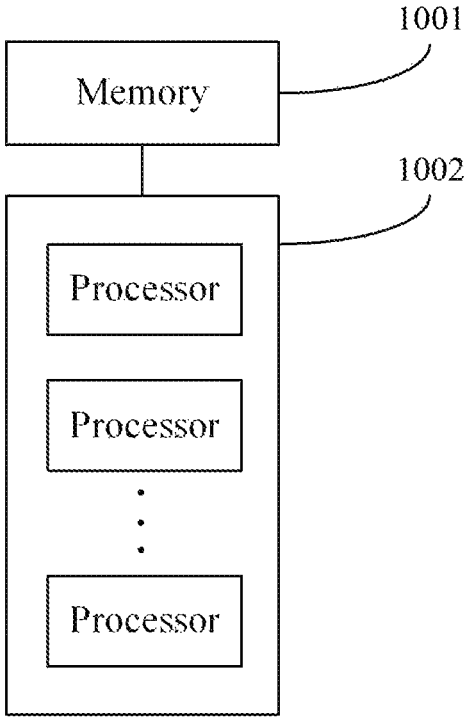
FIG. 10 is a structure diagram of a display device applied to an MVA wide viewing angle liquid crystal screen provided by some embodiments of the present disclosure.

As shown in FIG. 10, it is a structure diagram of a display device applied to an MVA wide viewing angle liquid crystal screen provided by some embodiments of the present disclosure. The display device includes a memory 1001 and one or more processors 1002, wherein one or more computer readable program codes may be stored in the memory 1001, and the one or more computer readable program codes stored in the memory 1001 may be executed by the one or more processors 1002 to achieve desired functions. For example, the processor 1002 may be configured to:

obtain a first frame and a second frame to be displayed, wherein the first frame and the second frame are two frames which are adjacent in the display order;

set pixels having the same coordinates in the first frame and the second frame as a group of pixels, wherein each group of pixels includes a first pixel in the first frame and a second pixel in the second frame; and adjust each group of pixels according to the following manner to obtain the adjusted first frame and the adjusted second frame: determining an average gray-scale value of the first pixel and the second pixel; modifying a first gray-scale value corresponding to the first pixel into a third gray-scale value, and modifying a second gray-scale value corresponding to the second pixel into a fourth gray-scale value, wherein when the third gray-scale value is larger than the average gray-scale value, the fourth gray-scale value is smaller than the average gray-scale value, and when the third gray-scale value is smaller than the average gray-scale value, the fourth gray-scale value is larger than the average gray-scale value; and control the MVA wide viewing angle liquid crystal screen to display the adjusted first frame and the adjusted second frame according to the display order.

Further, the average gray-scale value of the third gray-scale value corresponding to the first pixel and the fourth gray-scale value corresponding to the second pixel is equal to the average gray-scale value of the first gray-scale value corresponding to the first pixel and the second gray-scale value corresponding to the second pixel.

In addition, the processor 1002 may be further configured to:

determine corresponding first light transmittance according to a first gamma value, when the first pixel corresponds to the third gray-scale value;

determine third light transmittance corresponding to the average gray-scale value of the first gray-scale value corresponding to the first pixel and the second gray-scale value corresponding to the second pixel according to a preset third gamma value, wherein the third gamma value is a gamma value, which is set according to the average gray-scale value of the first gray-scale value corresponding to the first pixel and the second gray-scale value corresponding to the second pixel;

determine the double of a difference between the third light transmittance and the first light transmittance as the corresponding second light transmittance, when the second pixel corresponds to the fourth gray-scale value; and determine a corresponding second gamma value, according to the second light transmittance and the fourth gray-scale value corresponding to the second pixel, when the second pixel corresponds to the fourth gray-scale value.

Further, the processor 1002 may be further configured to: determine a corresponding gray-scale voltage according to the first gamma value, when the first pixel in the first frame corresponds to the third gray-scale value, and control the MVA wide viewing angle liquid crystal screen to display the first frame according to the gray-scale voltage, when the first pixel corresponds to the third gray-scale value; and determine a corresponding gray-scale voltage, according to the second gamma value, when the second pixel corresponds to the fourth gray-scale value, and control the MVA wide viewing angle liquid crystal screen to display the second frame according to the gray-scale voltage, when the second pixel corresponds to the fourth gray-scale value.

Further, the processor 1002 may be further configured to: group all the obtained frames to be displayed, wherein each group of frames only includes the first frame and the second frame which are adjacent in the display order, and the frames contained in any group of frames are different from the frames contained in other groups of frames.

Some embodiments of the present disclosure provide a display device applied to an MVA wide viewing angle liquid crystal screen. The display device may have the schematic diagram of the structure as shown in FIG. 10, the display device may include a memory 1001 and one or more processors 1002, the memory 1001 may be configured to store one or more computer readable program codes, and the one or more processors 1002 may be configured to execute the one or more computer readable program codes stored in the memory 1001 to achieve desired functions. For example, the processor 1002 may be configured to:

obtain a first frame and a second frame to be displayed, wherein the first frame and the second frame are two frames which are adjacent in the display order;

determine the gray-scale voltage of each pixel in the first frame according to a first gamma value, and determine the gray-scale voltage of each pixel in the second frame according to a second gamma value, wherein the first gamma value is a preset gamma value adopted by the first frame, the second gamma value is a gamma value determined via the first gamma value and adopted for the display of the second frame, and the first gamma value is different from the second gamma value; and control the MVA wide viewing angle liquid crystal screen to display the first frame according to the gray-scale voltage of each pixel in the first frame and then display the second frame according to the gray-scale voltage of each pixel in the second frame.

Further, the processor 1002 may be further configured to: obtain a third frame and a fourth frame to be displayed, wherein the third frame and the fourth frame are two frames which are adjacent in the display order and are displayed after the second frame;

determine the gray-scale voltage of each pixel in the third frame according to the second gamma value, and determine the gray-scale voltage of each pixel in the fourth frame according to the first gamma value; and control the MVA wide viewing angle liquid crystal screen to display the third frame, according to the gray-scale voltage of each pixel in the third frame and then display the fourth frame according to the gray-scale voltage of each pixel in the fourth frame.

Some embodiments of the present disclosure further provide a display device applied to an MVA wide viewing angle liquid crystal screen. The display device may have the structure as shown in FIG. 10, the display device may include a memory 1001 and one or more processors 1002, the memory 1001 may be configured to store one or more computer readable program codes, and the one or more processors 1002 may be configured to execute the one or more computer readable program codes stored in the memory 1001 to achieve desired functions. For example, the processor 1002 may be configured to:

obtain a first frame and a second frame to be displayed, wherein the first frame and the second frame are two frames which are adjacent in the display order;

divide the first frame into multiple first pixel groups, and divide the second frame into multiple second pixel groups, wherein each first pixel group includes two adjacent pixels, the pixels contained in each first pixel group are different, and the coordinates of the pixels in the second pixel groups correspond to the coordinates of the pixels in the first pixel groups in a one-to-one correspondence;

adjust gray-scale values of the pixels in the first pixel groups and corresponding second pixel groups according to the following manner to obtain the adjusted first frame and the adjusted second frame: determining a first gray-scale value corresponding to the first pixel in the first pixel group and a second gray-scale value corresponding to the second pixel in the first pixel group, and determining a first average gray-scale value according to the first gray-scale value and the second gray-scale value; modifying the first gray-scale value corresponding to the first pixel in the first pixel group into a third gray-scale value, and modifying the second gray-scale value corresponding to the second pixel into a fourth gray-scale value, wherein the third gray-scale value is larger than the first average gray-scale value, and the fourth gray-scale value is smaller than the first average gray-scale value; determining a fifth gray-scale value corresponding to a third pixel in the second pixel group and a sixth gray-scale value corresponding to a fourth pixel in the second pixel group, and determining a second average gray-scale value according to the fifth gray-scale value and the sixth gray-scale value; modifying the fifth gray-scale value corresponding to the third pixel in the second pixel group into a seventh gray-scale value, and modifying the sixth gray-scale value corresponding to the fourth pixel in the second pixel group into an eighth gray-scale value, wherein the seventh gray-scale value is smaller than the second average gray-scale value, and the eighth gray-scale value is larger than the eighth gray-scale value; and control the MVA wide viewing angle liquid crystal screen to display the adjusted first frame and the adjusted second frame according to the display order.

To sum up, according to the display device provided by some embodiments of the present disclosure, after obtaining the first frame and the second frame which are adjacent in the display order, the first gray-scale value corresponding to the first pixel in the first frame is modified into the third gray-scale value, and the second gray-scale value corresponding to the second pixel in the second frame is modified into the fourth gray-scale value, so that the difference between the gray-scale values of two pixels at the same positions in two continuous frames of images to be displayed is increased, resulting in that the difference between the gray-scale voltages obtained, when the two pixels at the same positions in the two continuous frames of images to be displayed are displayed, is increased. Under different gray-scale voltages, the liquid crystal deflection directions of the liquid crystal molecules are different, namely, the directions of the liquid crystal molecules are different, such that when the first frame is displayed, the deflection difference between the deflection direction of the liquid crystal molecules in the pixel structure in the liquid crystal display screen and the deflection direction when the second frame is displayed is increased, after human eyes view the displayed first frame and second frame, due to the afterglow effect of vision, an image obtained after the first frame and the second frame are displayed may be observed at different viewing angles, and at this time, the viewing angle of the liquid crystal display screen is increased on the premise of not increasing the number of sub-domains in the pixel structure of the liquid crystal display screen. In the liquid crystal display screen provided by the embodiment of the present disclosure, the display viewing angle of the liquid crystal display screen is increased without increasing the number of sub-domains in the pixel structure, so that the light transmittance of the liquid crystal display screen is not reduced on the premise of increasing the display viewing angle of the liquid crystal display screen. By adopting this method, the problem that the viewing angle of the liquid crystal display screen cannot be increased without changing the light transmittance of the liquid crystal display screen is solved.

Figure 11:
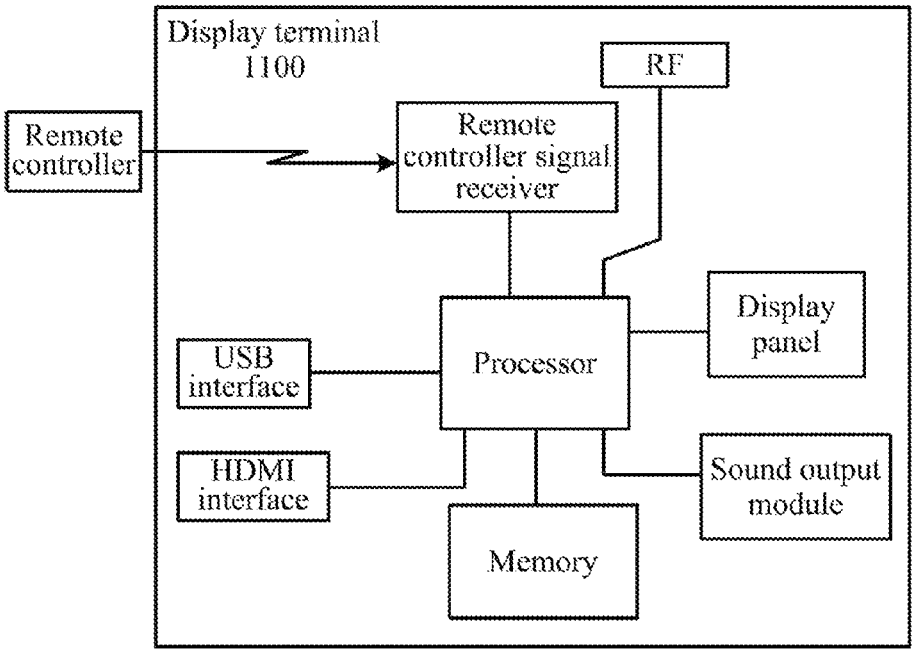
FIG. 11 is a schematic diagram of a structure of a display terminal provided by some embodiments of the present disclosure.

Some embodiments of the present application further provide a display terminal, wherein the display terminal may adopt the display method and device in the above embodiments. In some embodiments, as shown in FIG. 11, the display terminal 1100 may include a memory, an input unit, an output unit, one or more processors, etc. Those skilled in the art may understand that the structure of the display terminal as shown in FIG. 11 does not limit the display terminal, and the display terminal may include components more than or less than those shown in the figure, or some components are combined, or the components are disposed in different manners.

The memory may be configured to store software programs and modules, and the processor may operate the software programs and modules stored in the memory to execute various function applications and data processing. The memory may include a high speed random access memory and may further include a nonvolatile memory, for example, at least one disk storage device, a flash memory device, or other volatile solid storage devices. In addition, the memory may further include a memory controller for enabling the processor and the input unit to access the memory.

The processor is the control center of the display terminal 1100, is connected with the parts of the entire display terminal through various interfaces and circuits, operates or executes the software programs and/or modules stored in the memory, and dispatches the data stored in the memory to execute various function applications and data processing of the display terminal 1100, so as to integrally monitor the display terminal. Optionally, the processor may include one or more processing cores. Optionally, the processor may integrate an application processor and a modem processor, wherein the application processor mainly processes an operating system, a user interface, an application program, or the like, and the modem processor mainly processes wireless communication. It can be understood that the modem processor may be not integrated in the processor.

The display terminal 1100 may include such input units as a radio and television receiver, a high-definition multimedia interface, a USB port, an audio and video input structure and the like, and the input unit may further include a remote controller receiver for receiving signals transmitted by a remote controller. In addition, the input unit may further include a touch sensitive surface and other input devices. The touch sensitive surface may be implemented in a variety of types, for example, resistive type, capacitive type, infrared and surface acoustic wave and the liked. The other input devices may include, but not limited to, one or more of a physical keyboard, a function key (such as a volume control key, a switch key or the like), a trackball, a mouse, a joystick, etc.

The output unit is configured to output a sound signal, a video signal, an alarm signal, a vibration signal, etc. The output unit may include a display panel, a sound output module, etc. The display panel may be configured to display information input by the user or information provided to the user and display various graphical user interfaces of the display terminal 1100, and these graphical user interfaces may be composed of graphics, texts, icons, videos, and arbitrary combination thereof. For example, the display panel adopts an MVA wide viewing angle liquid crystal screen, or other LCD (Liquid Crystal Display, liquid crystal display), OLED (Organic Light-Emitting Diode, organic light emitting diode), flexible displays, three-dimensional displays, CRT, plasma display panels, etc.

The display terminal 1100 may further include at least one sensor (not shown in the figure), such as a light sensor, a motion sensor, and other sensors. Specifically, the light sensor may include an ambient light sensor and a proximity sensor, wherein the ambient light sensor may adjust the brightness of the display panel according to the brightness of ambient light, and the proximity sensor may close the display panel and/or backlight when the display terminal 1100 moves to a certain position. The display terminal 1100 may also be configured with other sensors, for example, a gyroscope, a barometer, a hygrometer, a thermometer, an infrared sensor, etc.

The display terminal 1100 may further include an audio circuit (not shown in the figure), a loudspeaker and a microphone, and the microphone may provide an audio interface between the user and the display terminal 1100. The audio circuit may convert received audio data into an electrical signal and transmit the electrical signal to the loudspeaker, and the loudspeaker converts the electrical signal into a sound signal and outputs the sound signal. On the other hand, the microphone converts the collected sound signal into the electrical signal, the audio circuit receives the electrical signal, converts the electrical signal into the audio data, and outputs the audio data to the processor for processing, and the processed audio data are transmitted to another display terminal, for example, or the audio data are output to the memory for further processing. The audio circuit may further include an earphone jack to provide communication of an external earphone with the display terminal 1100.

In addition, the display terminal 1100 may further include an RF (Frequency Radio, radio frequency) circuit. The RF circuit may be configured to receive and send signals. In general, the RF circuit includes, but not limited to, an antenna, at least one amplifier, a tuner, one or more oscillators, a subscriber identity module (SIM) card, a transceiver, a coupler, an LNA (low noise amplifier, low noise amplifier), a diplexer, etc. In addition, the display terminal 1100 may further include a camera, a Bluetooth module, etc.

In addition, the display terminal 1100 may further include a WiFi (wireless fidelity, wireless fidelity) module (not shown in the figure). WiFi belongs to short distance wireless transmission technology, and the display terminal 1100 may help the user to receive and send e-mails, browse web pages and access stream media, and the like, through the WiFi module, thus providing wireless broadband internet access for the user. The WiFi module does not belong to the necessary constitution of the display terminal 1100 and may be omitted within a range not changing the essence of the disclosure according to demand.

It should be noted that, any display terminal and/or display device in the above embodiments may adopt any display method for the MVA wide viewing angle liquid crystal screen mentioned in the above embodiments to achieve desired functions.

Those skilled in the art should understand that, the embodiments of the present disclosure may be provided as a method, a system, or a computer program product. Therefore, the present disclosure may adopt the form of a complete hardware embodiment, a complete software embodiment, or an embodiment combining software with hardware. Moreover, the present disclosure may adopt the form of a computer program product implemented on one or more computer available storage media (including, but not limited to, a magnetic disk memory, an optical memory and the like) including computer available program codes.

The present disclosure is described in accordance with the flowchart and/or the block diagram of the method, the equipment (system), and the computer program product of the embodiments of the present disclosure. It should be understood that each flow and/or block in the flowchart and/or the block diagram and the combination thereof can be implemented by computer program instructions. These computer program instructions can be provided to the processors of an all-purpose computer, a special-purpose computer, an embedded processor, or other programmable data processing devices to generate a machine, in order to generate a device configured to achieve appointed functions in one or more flows in the flowchart and/or one or more blocks in the block diagram, by means of the instructions executed by the processors of the computers or the other programmable data processing devices.

These computer program instructions can also be stored in a computer readable memory capable of guiding the computers or the other programmable data processing devices to work in a particular manner, in order to enable the instructions stored in the computer readable memory to generate a product including an instruction device, and the instruction device achieves the appointed functions in one or more flows in the flowchart and/or one or more blocks in the block diagram.

These computer program instructions can also be loaded on the computers or the other programmable data processing devices to execute a series of operation operations on the computers or the other programmable data processing devices to generate processing implemented by the computers, such that the instructions executed on the computers or the other programmable data processing devices provide operations used for achieving the appointed functions in one or more flows in the flowchart and/or one or more blocks in the block diagram.

Those skilled in the art can make various variations and modifications to the present disclosure, without departing from the scope of the present invention. In this way, if these modifications and variations of the present disclosure belong to the scope of the claims of the present disclosure and the equivalent technology thereof, the present disclosure is also intended to encompass these modifications and variations.

The invention claimed is:

1. A display device applied to an MVA (Multi-domain Vertical Alignment) wide viewing angle liquid crystal screen, the display device comprising:

a memory configured to store one or more computer readable program codes; and one or more processors configured to execute the one or more computer readable program codes to:

obtain a first frame and a second frame to be displayed, wherein the first frame and the second frame are two frames which are adjacent in a display order;

set pixels having same coordinates in the first frame and the second frame as respective groups of pixels, wherein each group of pixels comprises a first pixel in the first frame and a second pixel in the second frame;

adjust each group of pixels according to a following manner to obtain an adjusted first frame and an adjusted second frame:

determine an average gray-scale value of the first pixel and the second pixel; and modify a first gray-scale value corresponding to the first pixel into a third gray-scale value, and modify a second gray-scale value corresponding to the second pixel into a fourth gray-scale value, wherein when the third gray-scale value is larger than the average gray-scale value, the fourth gray-scale value is smaller than the average gray-scale value, and when the third gray-scale value is smaller than the average gray-scale value, the fourth gray-scale value is larger than the average gray-scale value; and control the MVA wide viewing angle liquid crystal screen to display the adjusted first frame and the adjusted second frame according to the display order.

2. The display device according to claim 1, wherein an average gray-scale value of the third gray-scale value corresponding to the first pixel and the fourth gray-scale value corresponding to the second pixel is equal to the average gray-scale value of the first gray-scale value corresponding to the first pixel and the second gray-scale value corresponding to the second pixel.

3. The display device according to claim 1, wherein before control of the MVA wide viewing angle liquid crystal screen to display the adjusted first frame and the adjusted second frame according to the display order, the one or more processors are further configured to execute the one or more computer readable program codes to:

determine corresponding first light transmittance according to a preset first gamma value when the first pixel corresponds to the third gray-scale value, wherein the preset first gamma value is adopted by the first frame;

determine third light transmittance corresponding to the average gray-scale value of the first gray-scale value corresponding to the first pixel and the second gray-scale value corresponding to the second pixel according to a preset third gamma value;

determine a double of a difference between the third light transmittance and the first light transmittance as a corresponding second light transmittance when the second pixel corresponds to the fourth gray-scale value; and determine a corresponding second gamma value, according to the second light transmittance and the fourth gray-scale value corresponding to the second pixel, when the second pixel corresponds to the fourth gray-scale value.

4. The display device according to claim 3, wherein to control the MVA wide viewing angle liquid crystal screen to display the adjusted first frame and the adjusted second frame according to the display order, the one or more processors are further configured to execute the one or more computer readable program codes to:

determine a corresponding gray-scale voltage according to the first gamma value, when the first pixel in the first frame corresponds to the third gray-scale value, and control the MVA wide viewing angle liquid crystal screen to display the first frame according to the gray-scale voltage, when the first pixel corresponds to the third gray-scale value; and determine a corresponding gray-scale voltage according to the second gamma value, when the second pixel corresponds to the fourth gray-scale value, and control the MVA wide viewing angle liquid crystal screen to display the second frame, according to the gray-scale voltage, when the second pixel corresponds to the fourth gray-scale value.

5. The display device according to claim 1, wherein to obtain a first frame and a second frame to be displayed, the one or more processors are further configured to execute the one or more computer readable program codes to:

group all obtained frames to be displayed into groups of frames, wherein each group of the groups of frames only comprises the first frame and the second frame which are adjacent in the display order, and frames contained in each group of the groups of frames are different from frames contained in other groups of the groups of frames.

6. A display device applied to an MVA (Multi-domain Vertical Alignment) wide viewing angle liquid crystal screen, the display device comprising:

a memory configured to store one or more computer readable program codes; and one or more processors configured to execute the one or more computer readable program codes to:

obtain a first frame and a second frame to be displayed, wherein the first frame and the second frame are two frames which are adjacent in the display order;

determine gray-scale voltage of each pixel in the first frame according to a preset first gamma value, and determine gray-scale voltage of each pixel in the second frame according to a second gamma value, wherein the preset gamma value is adopted by the first frame, the second gamma value is determined via the preset first gamma value and adopted by the second frame, and the first gamma value is different from the second gamma value; and control the MVA wide viewing angle liquid crystal screen to display the first frame according to the gray-scale voltage of each pixel in the first frame and then display the second frame according to the gray-scale voltage of each pixel in the second frame.

7. The display device according to claim 6, wherein the one or more processors are further configured to execute the one or more computer readable program codes to:

obtain a third frame and a fourth frame to be displayed, wherein the third frame and the fourth frame are two frames which are adjacent in the display order and are displayed after the second frame;

determine gray-scale voltage of each pixel in the third frame according to the second gamma value, and determine gray-scale voltage of each pixel in the fourth frame according to the first gamma value; and control the MVA wide viewing angle liquid crystal screen to display the third frame according to the gray-scale voltage of each pixel in the third frame and then display the fourth frame according to the gray-scale voltage of each pixel in the fourth frame.

8. A display device applied to an MVA (Multi-domain Vertical Alignment) wide viewing angle liquid crystal screen, the display device comprising:

a memory configured to store one or more computer readable program codes; and one or more processors configured to execute the one or more computer readable program codes to:

obtain a first frame and a second frame to be displayed, wherein the first frame and the second frame are two frames which are adjacent in the display order;

divide the first frame into a plurality of first pixel groups, and divide the second frame into a plurality of second pixel groups, wherein each first pixel group comprises at least two adjacent pixels, the pixels contained in each first pixel group are different, and coordinates of pixels in the second pixel groups correspond to coordinates of the pixels in the first pixel groups in a one-to-one correspondence;

adjust gray-scale values of the pixels in the first pixel groups and corresponding second pixel groups according to a following manner to obtain an adjusted first frame and an adjusted second frame:

determine a first gray-scale value corresponding to the first pixel in a first pixel group and a second gray-scale value corresponding to the second pixel in the first pixel group, and determine a first average gray-scale value according to the first gray-scale value and the second gray-scale value;

modify the first gray-scale value corresponding to the first pixel in the first pixel group into a third gray-scale value, and modify the second gray-scale value corresponding to the second pixel into a fourth gray-scale value, wherein the third gray-scale value is larger than the first average gray-scale value, and the fourth gray-scale value is smaller than the first average gray-scale value;

determine a fifth gray-scale value corresponding to a third pixel in a second pixel group and a sixth gray-scale value corresponding to a fourth pixel in the second pixel group, and determine a second average gray-scale value according to the fifth gray-scale value and the sixth gray-scale value; and modify the fifth gray-scale value corresponding to the third pixel in the second pixel group into a seventh gray-scale value, and modify the sixth gray-scale value corresponding to the fourth pixel in the second pixel group into an eighth gray-scale value, wherein the seventh gray-scale value is smaller than the second average gray-scale value, and the eighth gray-scale value is larger than the eighth gray-scale value; and control the MVA wide viewing angle liquid crystal screen to display the adjusted first frame and the adjusted second frame according to the display order.

* * * * *